United States Patent [19]

Keller et al.

[11] 4,031,659

[45] June 28, 1977

[54] TOY PICK-UP VEHICLE

[75] Inventors: Albert G. Keller, Chicago; Donald F. Nix, Hanover Park; Howard J. Morrison, Deerfield, all of Ill.

[73] Assignee: Marvin Glass & Associates, Chicago, Ill.

[22] Filed: Nov. 10, 1975

[21] Appl. No.: 630,719

[52] U.S. Cl. ..... 46/204; 15/41 R; 46/40; 46/141

[51] Int. Cl.[2] ..... A63H 17/00

[58] Field of Search ..... 46/40, 106, 202, 99, 46/204, 205, 141; 15/41 R; 198/7 R

[56] References Cited

UNITED STATES PATENTS

| | | | |
|---|---|---|---|
| 1,267,304 | 5/1918 | Adams | 15/41 R |
| 2,287,133 | 6/1942 | Reiter | 198/7 R |
| 3,080,592 | 3/1963 | Hassage | 15/50 |
| 3,197,918 | 8/1965 | Coggeshall | 46/103 |
| 3,240,201 | 3/1966 | Shelton | 46/205 X |
| 3,959,522 | 6/1976 | Leistikow | 46/205 |
| 3,983,662 | 10/1976 | Hart | 46/205 |

FOREIGN PATENTS OR APPLICATIONS

| | | | |
|---|---|---|---|
| 874,261 | 4/1953 | Germany | 46/40 |
| 873,669 | 4/1953 | Germany | 46/14 |
| 921,344 | 3/1963 | United Kingdom | 46/141 |

*Primary Examiner*—F. Barry Shay
*Attorney, Agent, or Firm*—Mason, Kolehmainen, Rathburn & Wyss

[57] ABSTRACT

A toy pick-up vehicle combination including a plurality of playing objects positionable upon a supporting surface such as a floor or the like. A toy vehicle is provided for picking up the playing objects and includes a vehicle body having a playing object receptacle. Wheels are provided for the vehicle body for moving the vehicle over the supporting surface. A spongy, resilient paddle wheel is rotatably mounted on the vehicle body for rotation with the wheels for engagement with the playing objects on the supporting surface and for moving the objects upwardly into the receptacle.

4 Claims, 4 Drawing Figures

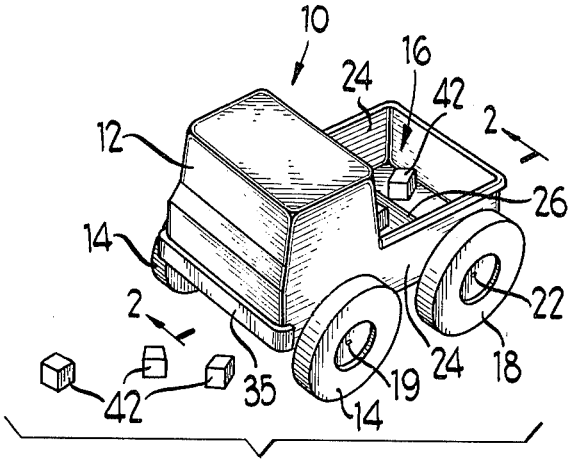
Fig 1
Fig 3
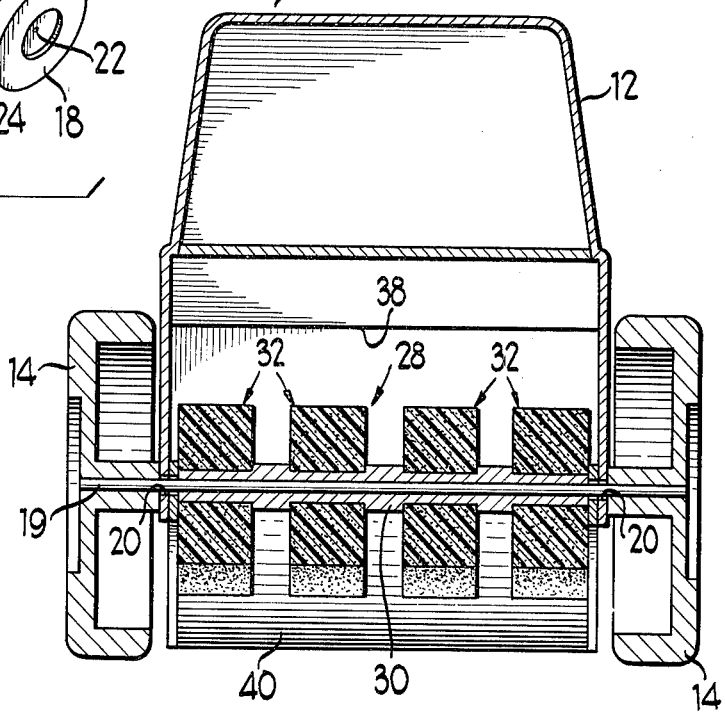
Fig 2
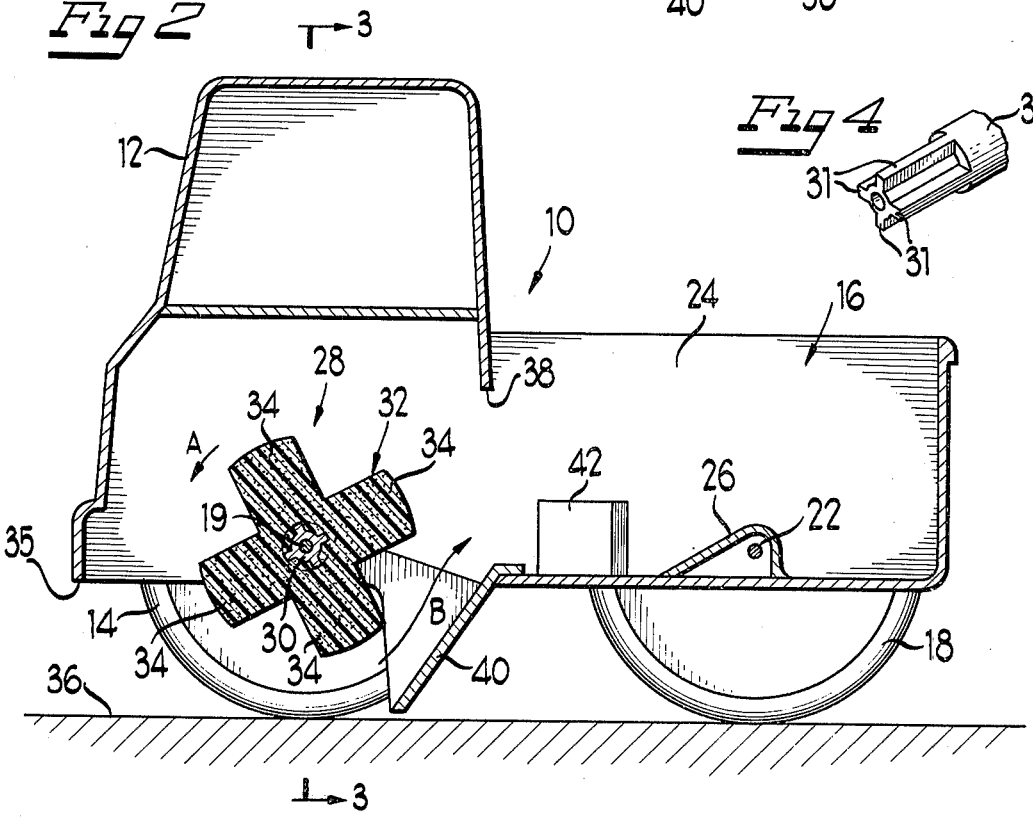
Fig 4
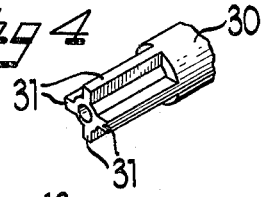

TOY PICK-UP VEHICLE

BACKGROUND OF THE INVENTION

This invention relates to a toy, particularly for pre-school children, and, specifically, a toy pick-up vehicle for picking up playing objects off a supporting surface such as a floor or the like.

Toy vehicles, particularly in the form of trucks having receptacle beds, have provided considerable enjoyment and play time for pre-school children throughout the years. The child uses the trucks for loading blocks and other objects thereinto, as well as for use in sandboxes and the like. This invention is directed to providing a novel pick-up vehicle which has the means for automatically picking up playing objects and depositing them into a receptable on the vehicle as the vehicle moves over a supporting surface.

More particularly, in the exemplary embodiment of the invention, a plurality of block-shaped playing objects are provided for positioning upon a supporting surface, such as a floor or the like. A toy vehicle in the form of a truck is provided for automatically picking up the playing objects and depositing the objects into a receptacle on the truck as the truck is moved over the supporting surface and over the playing objects. The vehicle, in the form of a pick-up truck, includes a front simulated passenger portion with a pair of front wheels rotatably mounted therebeneath. A rear open-top receptacle or bed portion of the truck is provided with a pair of rear wheels rotatably mounted therebeneath. A segmented paddle wheel is mounted on an axle between the front wheels for rotation therewith. A direct opening is provided between the paddle wheel and the rear vehicle receptacle or bed, with a lower deflector member extending beneath the body portion in close proximity to the supporting surface. The front of the passenger portion of the pick-up truck terminates above the supporting surface a sufficient distance for the playing objects to pass therebeneath and into engagement with the paddle wheel whereupon the paddle wheel, on rotation, directs the playing objects rearwardly into the receptacle or bed of the truck. In the exemplary embodiment, the paddle wheel is substantially fabricated of resilient spongy material and the playing objects block-shaped end of a size so as to be grasped by the paddle wheel to move the playing objects into the truck bed.

Other objects, features and advantages of the invention will be apparent from the following detailed description taken in connection with the accompanying drawings.

BRIEF DESCRIPTION OF THE DRAWINGS

FIG. 1 is a perspective view of the pick-up truck of the present invention along with a plurality of block-shaped playing objects;

FIG. 2 is a front to rear vertical section, on an enlarged scale, taken generally along the line 2—2 of FIG. 1;

FIG. 3 is a vertical section taken generally along the line 3—3 of FIG. 2; and

FIG. 4 is a fragmented perspective view of the paddle wheel shaft.

DETAILED DESCRIPTION OF THE INVENTION

The toy pick-up vehicle of the present invention, generally designated 10, is in the form of a pick-up truck having a front simulated passenger portion 12 with a pair of front wheels 14 rotatably mounted therebeneath. The truck has a rear open top receptacle or bed portion, generally designated 16, having a pair of rear wheels 18 rotatably mounted therebeneath. As best seen in FIG. 3, the front wheels 14 are mounted on a front shaft or axle 19 journalled on the passenger portion of the vehicle body in apertures 20 (FIG. 3). The front wheels 14 and axle 19 are secured for conjoint rotation.

The rear wheels 18 are mounted on a rear axle 22 (FIG. 2) which is journalled in the sides 24 of the truck bed 16 and is covered by a shield 26 (FIG. 2). Paddle wheel means, generally designated 28 (FIGS. 2 and 3), is fixed to the front axle 19 for rotation therewith as the front wheels 14 move over a supporting surface. The paddle wheel means 28 includes an inner core portion 30 which is fixed to the front axle 18. The core portion has axially spaced sets of cutouts 31 (see FIG. 4) which mate with complementary interior shapes of a plurality of axially spaced paddle wheel segments, generally designated 32. As seen in FIG. 2, each paddle wheel segment has four paddles 34 extending radially outwardly from the core 30. The paddle wheel segments 32 are fabricated of resilient spongy material to provide friction an give or yieldability as the paddle wheel rotates to engage an object so as to deposit the object in the truck receptacle or bed 16.

To this end, the front of the simulated passenger portion 12 of the truck terminates, at 35 (FIG. 2), a distance spaced above a supporting surface, such as 36. This provides a lower object inlet means or space beneath the front of the passenger portion 12 through which a playing object may pass for engagement with the paddle wheel means 28 as it rotates in the direction of arrow A as the truck moves forwardly over the supporting surface. Conduit direct opening 38 is provided in the vehicle body between the passenger portion 12 and the receptacle or bed 16 (as seen in FIG. 2) to provide communication between the paddle wheel 28 and the inside of the truck bed. Furthermore, a lower deflector member 40 extends beneath the truck bed beneath the opening 38 to facilitate directing playing objects into the truck bed in the direction of arrow B as the paddle wheel rotates in the direction of arrow A.

Block-shaped playing objects 42 (FIG. 1) are provided of a size and shape so as to pass under the front 35 of the simulated passenger portion of the truck and between the paddle wheel means 28 and the deflector member 40 into the truck bed. Of course, other sizes and shapes of objects can be picked up by utilizing the toy of the present invention.

The foregoing detailed description has been given for clearness of understanding only and no unnecessary limitations should be understood therefrom as some modifications will be obvious to those skilled in the art.

We claim:

1. A toy vehicle for picking up playing objects from a supporting surface, comprising:

a vehicle body having a lower object inlet means generally at the front thereof;

front and rear wheel means on the vehicle for supporting the vehicle for movement over the supporting surface;

a paddle wheel rotatably mounted on the vehicle body for conjoint rotation with said front wheel means for engagement with objects on the supporting surface and moving the objects therewith;

a rear receptacle disposed behind said paddle wheel and generally above said rear wheel means; and conduit means between said paddle wheel and said receptacle including a direct opening in the vehicle body between the paddle wheel and the rear receptacle and a lower deflector member extending beneath said opening in proximity with the surface;

said paddle wheel being fabricated substantially of resilient, soft spongy material to provide friction and yieldability as the paddle wheel rotates to engage the objects for movement upwardly through said opening into said rear receptacle.

2. The toy vehicle of claim 1 wherein said vehicle is in the form of a toy pick-up truck including a front simulated passenger portion with said front wheel means rotatably mounted therebeneath, said receptacle being disposed behind the passenger portion with said rear wheel means rotatably mounted therebeneath, the front of said simulated passenger portion terminating a distance above the supporting surface to define said inlet means to permit objects to pass therebeneath and into engagement with the paddle wheels.

3. The toy vehicle of claim 1 including, in combination, a plurality of playing objects positionable on said supporting surface for engagement by said paddle wheel.

4. The toy vehicle of claim 3 wherein said playing objects are block-shaped.

* * * * *